United States Patent [19]

Terauchi

[11] Patent Number: 4,664,604

[45] Date of Patent: May 12, 1987

[54] SLANT PLATE TYPE COMPRESSOR WITH CAPACITY ADJUSTING MECHANISM AND ROTATING SWASH PLATE

[75] Inventor: Kiyoshi Terauchi, Gunma, Japan

[73] Assignee: Sanden Corporation, Gunma, Japan

[21] Appl. No.: 704,025

[22] Filed: Feb. 21, 1985

[30] Foreign Application Priority Data

Feb. 21, 1984 [JP] Japan ..... 59-29654

[51] Int. Cl.[4] ..... F04B 1/26

[52] U.S. Cl. ..... 417/222; 417/270

[58] Field of Search ..... 417/222, 269, 270; 92/122

[56] References Cited

U.S. PATENT DOCUMENTS

| | | | |
|---|---|---|---|
| 4,011,029 | 3/1977 | Shimizu | 417/269 |
| 4,073,603 | 2/1978 | Abendschein et al. | 417/222 |
| 4,145,163 | 3/1979 | Fogelberg et al. | 417/222 |
| 4,174,191 | 12/1979 | Roberts | 417/222 |
| 4,425,837 | 1/1984 | Livesay | 417/269 |
| 4,475,871 | 10/1984 | Roberts | 417/270 |
| 4,526,516 | 7/1985 | Swain | 92/12.2 |

FOREIGN PATENT DOCUMENTS

| | | | |
|---|---|---|---|
| 1463390 | 10/1972 | United Kingdom | 417/222 |

*Primary Examiner*—Carlton R. Croyle
*Assistant Examiner*—Paul F. Neils
*Attorney, Agent, or Firm*—Banner, Birch, McKie and Beckett

[57] ABSTRACT

A slant plate type compressor with capacity adjusting mechanism is disclosed. The compressor housing has a cylinder block provided with a plurality of cylinders and a piston slides within each cylinder. The piston is reciprocated by a swash plate driven by a drive shaft through a hinge coupling mechanism which includes a mechanism for changing the slant angle of the swash plate. The swash plate is supported for nutational (wobbling) and rotational motion on the drive shaft through a spherical bush and is operatively connected to the pistons through bearing shoes. Accordingly, each piston accomplishes reciprocating movement within a cylinder by the rotation of the swash plate and the stroke of piston is changed by the hinge coupling mechanism due to a pressure difference between the crank chamber and the suction chamber.

5 Claims, 2 Drawing Figures

SLANT PLATE TYPE COMPRESSOR WITH CAPACITY ADJUSTING MECHANISM AND ROTATING SWASH PLATE

TECHNICAL FIELD

The present invention relates to a refrigerant compressor, and more particularly, to a slant plate type compressor for an air conditioning system in which the compressor includes a mechanism for adjusting the capacity of the compressor.

BACKGROUND OF THE INVENTION

Generally, in air conditioning apparatus, thermal control is accomplished by intermittent operation of the compressor in response to a signal from a thermostat located in the room being cooled. Once the temperature in the room has been lowered to a desired temperature, the refrigerant capacity of the air conditioning system generally need not be very large in order to handle supplemental cooling because of further temperature changes in the room or for keeping the room at the desired temperature. Accordingly, after the room has cooled downs to the desired temperature, the most common technique for controlling the output of the compressor is by intermittent operation of the compressor. However, this intermittent operation of the compressor results in the intermittent application of a relatively large load to the driving mechanism of the compressor in order to drive the compressor.

In an automobile air conditioning compressor, the compressor is driven by the engine of the automobile through an electromagnetic clutch. Automobile air conditioning compressors face the same intermittent load problems described above once the passenger compartment reaches a desired temperature. Control of the compressor normally is accomplished by intermittent operation of the compressor through the electromagnetic clutch which couples the automobile engine to the compressor. Thus, the relatively large load which is required to drive the compressor is intermittently applied to the automobile engine.

Furthermore, since the compressor of an automobile air conditioner is driven by the engine of the automobile, the rotation frequency of the drive mechanism changes from moment to moment, which causes the refrigerant capacity to change in proportion to the rotation frequency of the engine. Since the capacity of the evaporator and the condenser of the air conditioner does not change, when the compressor is driven at high rotation frequency, the compressor performs useless work. To avoid performing useless work, prior art automobile air conditioning compressors often are controlled by intermittent operation of the magnetic clutch. However, this again results in a large load being intermittently applied to the automobile engine.

One solution to above-mentioned problems is to control the capacity of the compressor in response to refrigeration requirements. One construction to adjust the capacity of a compressor, particularly a wobble plate type compressor, is disclosed in the U.S. Pat. No. 3,861,829 issued to Roberts et al. Roberts et al. discloses a wobble plate type compressor which has a cam rotor driving device to drive a plurality of pistons and varies the slant angle of the slant surface to change the stroke length of the pistons. since the stroke length of pistons within cylinders is directly responsive to the slant angle of the slant surface, the displacement of compressor is easily adjusted by changing the slant angle.

In these prior art wobble plate type compressors with capacity adjusting mechanisms, the compressor should be provided with a rotation preventing device for the wobble plate. One rotation preventing mechanism is disclosed in the U.S. Pat. No. Re. 27,844 issued to Olson. The rotation preventing mechanism disclosed in the Olson patent comprises a pair of bevel gears, one of which is fixed on the center of the wobble plate and another which is supported on the housing, and a ball element seated in seating portion formed on the center portion of each bevel gear. Therefore, the wobble plate is supported on the ball element and rotation of wobble plate is prevented by engagement of bevel gears while permitting nutational motion along the ball surface. However, since in the above-mentioned wobble plate type compressor with a capacity adjusting mechanism, the slant angle of the wobble plate could be changed in response to the refrigeration requirements, the pair of bevel gears cannot be used as the rotation preventing mechanism.

Therefore, generally a pin rod connection is used in the wobble plate compressor as the rotation preventing mechanism. In this mechanism, the wobble plate is supported on the ball element or drive shaft but rotation of the wobble plate is prevented by a pin fixed to the lower end of the wobble plate. The pin is slidably fitted in an axial groove formed in an inner wall of the compressor housing. In this arrangement, the pin reciprocates along the groove with considerable sliding friction between the pin and groove thereby introducing a power loss. Particularly since sliding friction changes in response to the moving range of the wobble plate, the wobbling angular velocity which should be transferred to the wobble plate is not uniform during the changing of the slant angle of the wobble plate. Furthermore, the pin is subjected to an undesired force so that the reliability of the pin and the compressor unit as a whole is thus degraded, and the compressor housing is required to be large because the groove must be formed therein.

SUMMARY OF THE INVENTION

It is a primary object of this invention to provide a refrigerant compressor with a capacity adjusting mechanism which has highly reliable rotation preventing mechanism.

It is another object of this invention to provide a refrigerant compressor with a capacity adjusting mechanism wherein angular velocity of slant plate is maintained uniform while changing the slant angle of the wobble plate.

It is still another object of this invention to accomplish the above objects with a refrigerant compressor that is simple in construction.

A refrigerant compressor according to this invention includes a compressor housing having a cylinder block with a plurality of cylinders and a crank chamber adjacent the cylinder block. A piston is slidably disposed within each cylinder and is reciprocated by a swash plate driven by an input drive shaft. The drive shaft is rotatably supported by the compressor housing. A front end plate, which rotatably supports the drive shaft through a bearing, is disposed in an opening of the crank chamber. A rear end plate, which is disposed at the opposite end of the housing, includes a suction chamber and a discharge chamber for refrigerant. The rear end plate is fixed on the housing together with a valve plate.

The crank member and the suction chamber are connected by a passage, the opening and closing of which are controlled by a control mechanism.

The swash plate is supported on the drive shaft for nutational motion and is driven by the drive shaft through a hinge mechanism which enables the slant angle of the swash plate to be varied. Each piston is coupled with the swash plate through a bearing shoe which permits the rotating movement of the swash plate.

Further objects, features and other aspects of this invention will be understood from the following detailed description of the preferred embodiment of this invention with reference to the annexed drawing.

DETAILED DESCRIPTION OF THE PREFERRED EMBODIMENT

Figure 1:
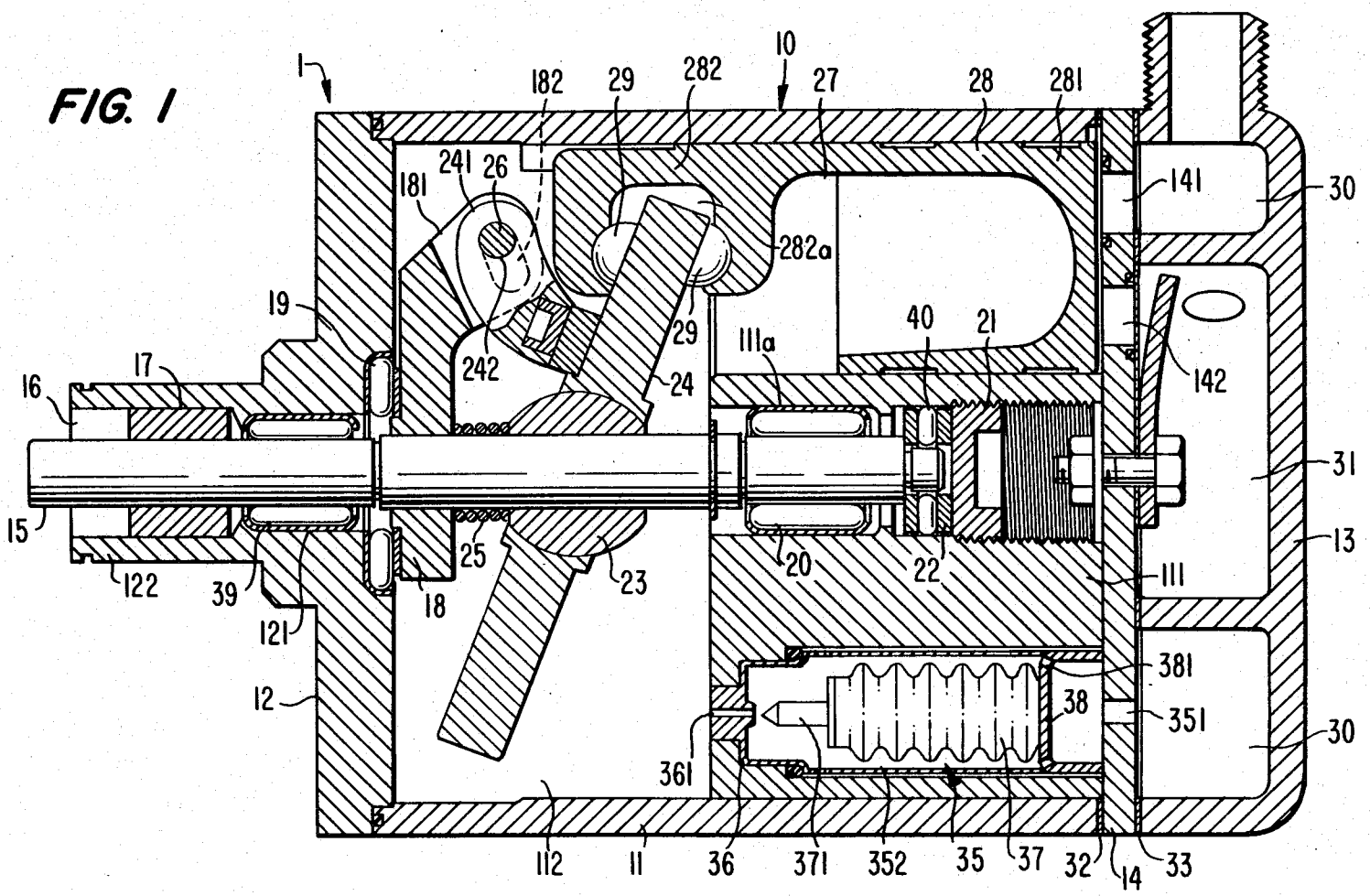
FIG. 1 is a vertical sectional view of a refrigerant compressor according to the preferred embodiment of this invention.

Referring to FIG. 1, a refrigerant compressor according to this invention is shown. The compressor, which is generally designated by reference number 1, includes a closed cylinder housing assembly 10 formed by an annular casing 11 provided with a cylinder block 111 at one of its sides, a hollow portion such as crank member 112, a front end plate 12 and a rear end plate 13.

Front end plate 12 is mounted on the left end opening of annular casing 11 to close the end opening of crank chamber 112 and is fixed on casing 11 by a plurality of bolts (not shown). Rear end plate 13 and a valve plate 14 are mounted on the other end of casing 11 by a plurality of bolts (not shown) to cover the end portion of cylinder block 111. An opening 121 is formed in front end plate 12 for receiving drive shaft 15. An annular sleeve 122 projects from the front end surface of front end plate 12 and surrounds drive shaft 15 to define a shaft seal cavity 16. A shaft seal assembly 17 is assembled on drive shaft 15 within shaft seal cavity 16.

Drive shaft 15 is rotatably supported by front end plate 12 through bearing 39, which is disposed within opening 121. The inner end of drive shaft 15 is provided with a rotor plate 18. A thrust needle bearing 19 is placed between the inner end surface of front end plate 12 and the adjacent axial end surface of rotor plate 18 to receive the thrust load that acts against rotor plate 18 and to ensure smooth motion. The outer end of drive shaft 15, which extends outwardly from sleeve 122, is driven by the engine of a vehicle through a conventional pully arrangement. The inner end of drive shaft 15 extends into a central bore 111*a* formed in the center portion of cylinder block 111 and is rotatably supported therein by a bearing such as radial needle bearing 20. The axial position of drive shaft 15 can be adjusted by adjusting screw 21 which is screwed into a threaded portion of central bore 111*a*. A spring device 22 is disposed between the axial end surface of drive shaft 15 and adjusting screw 21. A thrust needle bearing 40 is placed between drive shaft 15 and spring device 22 to ensure smooth rotation of drive shaft 15.

A spherical bush 23, which is placed between rotor plate 18 and the inner end of cylinder block 111, is slidably carried on drive shaft 15. Spherical bush 23 supports a slant or swash plate 24 for both nutational (wobbling) and rotating motion. A coil spring 25 surrounds drive shaft 15 and is placed between the end surface of rotor plate 18 and one axial end surface of bush 23 to push spherical bush 23 toward cylinder block 111.

Swash plate 24 is connected with rotor plate 18 through a hinge coupling mechanism for rotation in unison with rotor plate 18. That is, rotor plate 18 has an arm portion 181 projecting axially outwardly from one side surface thereof and swash plate 24 also has second arm portion 241 projecting toward arm portion 181 of rotor plate 18 from one side surface thereof. In this embodiment, as shown in FIG. 1, second arm portion 241 is formed separately from swash plate 24 and is fixed on one side surface of swash plate 24. Arm portions 181, 241 overlap each other and are connected to one another by a pin 26 which extends into a rectangular shaped hole 182 formed through arm portion 181 of rotor plate 18 and a pin hole 242 formed through second arm portion 241 of swash plate 24. In this manner, rotor plate 18 and swash plate 24 are hinged to one another. In this construction, pin 26 is slidably disposed in rectangular hole 182, and the sliding motion of pin 26 within rectangular hole 182 changes the slant angle of the inclined surface of swash plate 24.

Cylinder block 111 has a plurality of annularly arranged cylinders 27 into which pistons 28 slide. A typical arrangement includes five cylinders, but a smaller or larger number of cylinders may be provided. Each piston 28 comprises a head portion 281 slidably disposed within cylinder 27 and a connecting portion 282. Connecting portion 282 of pistons 28 has a cutout portion 282*a* which straddles the outer peripheral portion of swash plate 24. Semi-spherical thrust bearing shoes 29 are disposed between each side surface of swash plate 24 and face the inner surface of connecting portion 282 for sliding along the side surface of swash plate 24. The rotation of drive shaft 15 causes the swash plate 24 to rotate between bearing shoes 29 and to move the inclined surface axially to the right and left, thereby reciprocating pistons 28 within cylinders 27.

Rear end plate 13 is shaped to define a suction chamber 30 and a discharge chamber 31. Valve plate member 14, which together with rear end plate 13 is fastened to the end of cylinder block 111 by screws, is provided with a plurality of valved suction ports 141 connected between suction chamber 30 and respective cylinders 27, and a plurality of valved discharge ports 142 connected between discharge chamber 31 and respective cylinders 27. Suitable reed valves for suction ports 141 and discharge ports 142 are described in U.S. Pat. No. 4,011,029. Gaskets 32, 33 are placed between cylinder block 111 and valve plate 14, and between valve plate 14 and rear end plate 13, to seal the mating surfaces of cylinder block, valve plate and the rear end plate.

As shown in bottom, right-hand portion of FIG. 1, crank chamber 112 and suction chamber 30 are connected by a passageway 35 which comprises an aperture 351 formed through valve plate 14 and gaskets 32, 33 and a bore 352 formed in cylinder block 111. A coupling element 36 with a small aperture 361 is disposed in the one end opening of bore 352 which faces crank chamber 112, and a bellows element 37 containing gas and having a needle valve 371 is diposed in bore 352. The opening and closing of small aperture 361 which is connected between crank chamber 112 and bore 35 is controlled by needle valve 371, and axial position of bellows element 37 is determined by frame element 38 disposed in bore 352. At least one hole 381 is formed through frame 38 to communicate between aperture 351 and bore 352.

In operation, drive shaft 15 is rotated by the engine of a vehicle through the pully arrangement, and rotor plate 18 is rotated together with drive shaft 15. The rotation of rotor plate 18 is transferred to swash plate 24 through the hinge coupling mechanism so that, with respect to the rotation of rotor plate 18, the inclined surface of swash plate 24 moves axially to the right and left. Pistons 28, which are operatively connected to swash plate 24 by means of swash plate 24 sliding between bearing shoes 29, therefore reciprocate within cylinders 27. As pistons 28 reciprocate, the refrigerant gas which is introduced into suction chamber 30 from the fluid inlet port is taken into each cylinder 27 and compressed. The compressed refrigerant is discharged to discharge chamber 31 from each cylinder 27 through a discharge port 142 and therefrom into an external fluid circuit, for example, a cooling circuit through the fluid outlet port.

When the heat load of the refrigerant exceeds a predetermined level, the suction pressure is increased. Therefore, in this case, if the pressure of the gas contained in bellows element 37 is set almost the same as the pressure in predetermined heat load level, bellows element 37 is pushed toward the right side to open aperture 361. This situation is shown in FIG. 1. Thus, the pressure in crank chamber 112 is maintained at the suction pressure. In this condition, during the compression stroke of the pistons, reaction force of gas compression normally acts against swash plate 24 and is finally received by the hinge coupling mechanism. A moment $M_1$ which is caused by the reaction force acting on piston 28 thus acts against the hinge coupling mechanism to cause clockwise rotation. A moment $M_2$ is caused by the recoil strength of coil spring 25; and a moment $M_3$ is caused by a pressure difference between crank chamber 112 and suction chamber 30. Thus, when aperture 361 is open and no pressure difference exists between crank chamber 112 and suction chamber 30, only moment $M_2$ is opposed to moment $M_1$. Therefore, if the recoil strength of coil spring 25 is set to achieve $M_1$ greater than $M_2$, swash plate member 24 moves toward plate body 181 and is rotated about the pin 26 of hinge coupling mechanism with pin 26 pushed to the upper end portion of rectangular hole 182. Therefore, the slant angle of swash plate 24 is maximized relative to the vertical plane. This results in the maximum stroke of pistons 28 within cylinder 27 which corresponds to the normal refrigerant capacity of the compressor.

Figure 2:
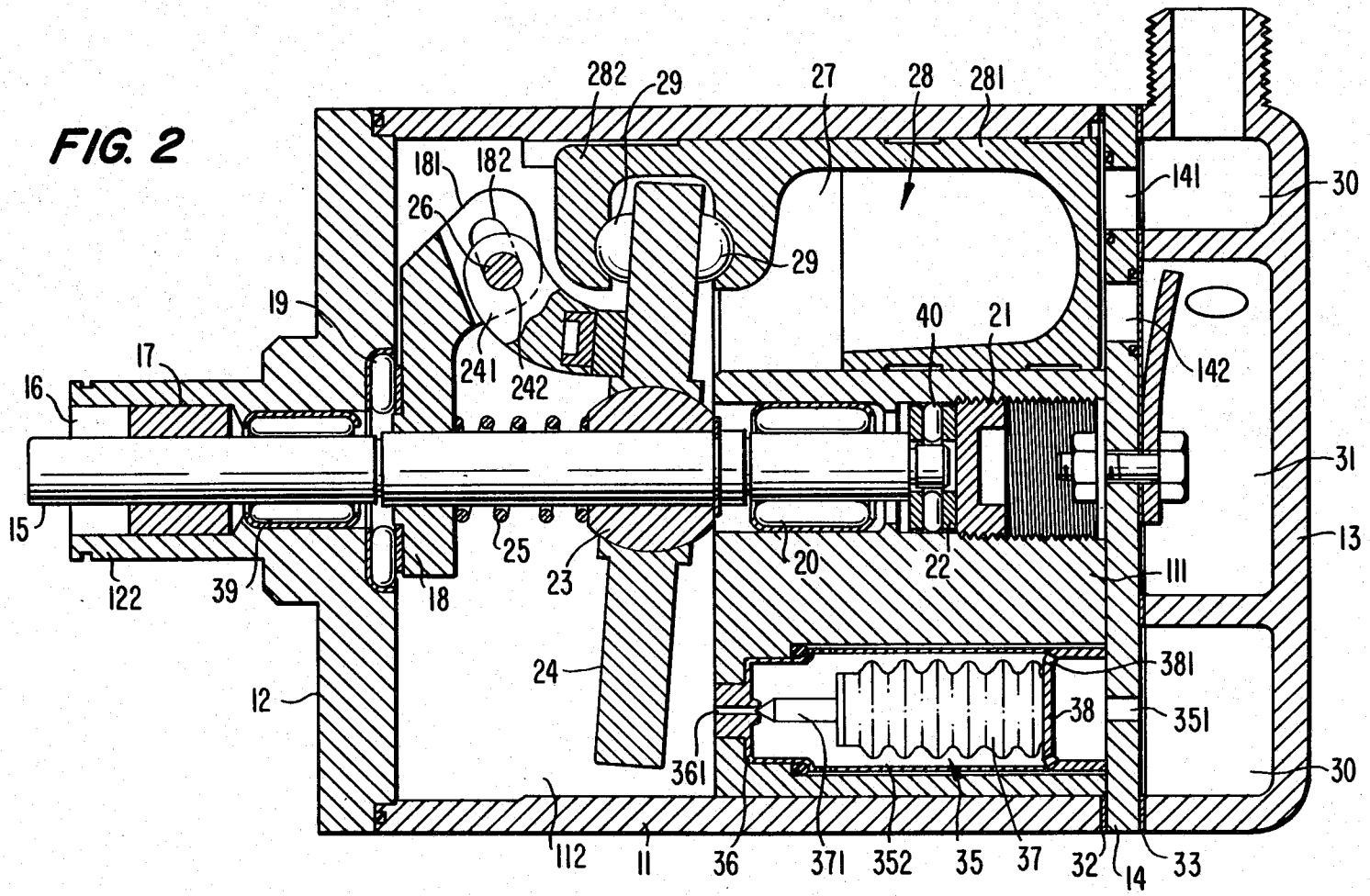
FIG. 2 is a sectional view similar to FIG. 1 illustrating a minimum slant angle of the swash plate.

On the other hand, if the heat load is decreased and the refrigerant capacity is exceeded, the pressure in suction chamber 30 is decreased, and bellows element 37 is moved to the left side to close small aperture 361 with needle valve 371. This situation is shown in FIG. 2. In this case, the pressure in crank chamber 112 is gradually raised and a narrow pressure difference occurs because blow-by gas, which leaks from the cylinder chamber to crank chamber 112 through a gap between the piston and cylinder during the compression stroke, is contained in crank chamber 112. During the rising of pressure in crank chamber 112, moment $M_3$ is generated and rises in magnitude in response to the rising of pressure in crank chamber 112. This moment $M_3$ is opposed to the moment $M_1$ so that at some point, the total magnitude of moments $M_2$ and $M_3$ exceeds the moment $M_1$. When this occurs, a moment in a counterclockwise direction about pin 26 of hinge coupling mechanism acts on swash plate 24 so that the slant angle of swash plate 24 with respect to the vertical plane decreases. Decreasing the slant angle continues until pin 26 contacts the lower end portion of rectangular hole 182. As the slant angle decreases, the stroke of the piston 28 in the cylinder 27 is reduced and the capacity of the compressor gradually decreases. Since it is undesirable to completely stop movement of the pistons because the flow of refrigerant gas and lubricating oil would also stop, some movement of the pistons should be maintained to continue lubrication of the compressor.

As mentioned above, in this invention each piston is operatively connected to the swash plate to cause the reciprocating motion within cylinders and the swash plate is supported on the drive shaft through a bushing for both nutational and rotational motion. The rotation of the drive shaft is transferred to the swash plate through the rotor plate and the hinge coupling mechanism in such a manner to enable the change of the slant angle of the swash plate in response to the pressure difference between the suction chamber and the crank chamber. Therefore, a rotation preventing mechanism for a wobble plate is not required and the change of the slant angle of the swash plate is easily accomplished by the hinge coupling mechanism.

Although the invention has been described in detail in connection with a preferred embodiment, it will be understood by those skilled in the art that this embodiment is only for illustration. Various modifications may be made therein by one skilled in the art without departing from the scope or spirit of this invention, which is only limited by the appended claims.

I claim:

1. A refrigerant compressor including a compressor housing having a cylinder block with a plurality of cylinders and a crank chamber adjacent said cylinder block, a piston slidably received within each of the cylinders, a swash plate for reciprocating said cylinders, said swash plate being driven by an input drive shaft and being supported in said housing for both rotational and nutational motion, a front end plate disposed on said compressor housing for rotatably supporting said drive shaft, a rear end plate disposed on the opposite end of said compressor housing and having a suction chamber and a discharge chamber, a passage means to communication between said crank chamber and said suction chamber, valve means for controlling the closing and opening of said passage means, a spherical bush supporting said swash plate for said nutational and rotational motion on said drive shaft, and a hinge coupling mechanism drivingly connecting said swash plate to said input drive shaft to rotate said swash plate, said hinge coupling mechanism including means for changing the slant angle of an inclined surface of said swash plate in response to changes in pressure in said crank chamber.

2. The refrigerant compressor of claim 1 wherein said piston comprises a cylindrical head portion reciprocally disposed within said cylinder and a connecting portion having a cutout portion to straddle the outer peripheral portion of said swash plate, and said swash plate is operatively connected to the connecting portion of said piston through a bearing shoe.

3. The refrigerant compressor of claim 1 wherein said input drive shaft is provided with a rotor plate at its inner end and said swash plate is connected with said rotor plate by the hinge coupling mechanism.

4. The refrigerant compressor of claim 3 wherein said hinge coupling mechanism comprises a pair of arm portions projecting from said rotor plate and said swash plate and overlapping each other, and a pin extending into a rectangular hole formed through one of said arm portions and a pin hole formed through other arm portions.

5. The refrigerant compressor of claim 3 wherein a coil spring is disposed between said rotor plate and said spherical bush to push said bush toward said cylinder block.

* * * * *